United States Patent [19]

Bunz

[11] Patent Number: 4,958,420

[45] Date of Patent: Sep. 25, 1990

[54] PLUG-TYPE CLASP FOR PIECES OF JEWELRY

[76] Inventor: Georg Bunz, Obere Bergstr. 16, D-7544 Dobel, Fed. Rep. of Germany

[21] Appl. No.: 472,026

[22] Filed: Jan. 30, 1990

[30] Foreign Application Priority Data

Feb. 4, 1989 [DE] Fed. Rep. of Germany ..... 3903342

[51] Int. Cl.[5] ..... A44C 11/00; F16B 1/00

[52] U.S. Cl. ..... 24/653; 24/616; 24/701

[58] Field of Search ..... 24/653, 651, 652, 654, 24/616, 617, 618, 615, 701, 595, 596, 585; 403/353, 316, 317

[56] References Cited

U.S. PATENT DOCUMENTS

| | | | |
|---|---|---|---|
| 3,570,078 | 3/1971 | Neumann et al. | 24/701 |
| 4,246,680 | 1/1981 | Gray | 24/616 |
| 4,566,159 | 1/1986 | Leroux | 24/618 |
| 4,571,788 | 2/1986 | Bruengger | 24/652 |

FOREIGN PATENT DOCUMENTS

| | | |
|---|---|---|
| 0121953 | 10/1984 | European Pat. Off. . |
| 246399 | 9/1911 | Fed. Rep. of Germany . |
| 1193906 | 6/1970 | United Kingdom . |

*Primary Examiner*—Victor N. Sakran

*Attorney, Agent, or Firm*—Spensley, Horn, Jubas & Lubitz

[57] ABSTRACT

A plug-type clasp for pieces of jewerly, in particular for necklaces, composed of a housing in which a sleeve is movable under the force of a spring. The sleeve has a receiving opening into which a connecting element can be inserted through a front-end opening of the housing and locked there. Both the front-end opening of the housing and the receiving opening of the sleeve are eccentrically offset from each other, so that the connecting element can only be inserted into the housing, and locked there, only after the sleeve has been pulled back against the force of the spring. Removal of the connecting part can take place in the correspondingly reversed order. Activation of the sleeve for unlocking the plug-type clasp takes place by means of an operating button, laterally guided in a longitudinal hole of the housing, so that the actual connecting areas of the plug-type clasp for pieces of jewelry, in particular necklaces, remain free of pulling stresses during the operation of the plug-type clasp. With the exception of the spring and sleeve, no other movable parts are required.

8 Claims, 1 Drawing Sheet

PLUG-TYPE CLASP FOR PIECES OF JEWELRY

BACKGROUND OF THE INVENTION

1. Field of the Invention

The invention relates to a plug-type clasp for pieces of jewelry, in particular necklaces. The invention is particularly directed to a clasp having a housing, the front end of which is acted on internally by one end of a spring. The other end of the spring acts on a sleeve which is movable inside the housing and which has a receiving opening directed towards the other end of the housing. A connecting part can be inserted into this receiving opening via an opening in one end of the housing, and locked there.

2. Prior Art

A plug-type clasp having a structure of this type is disclosed in EP No. 0 121 953-A1, particular reference being made to FIG. 3 of that publication. In this known plug-type clasp, the sleeve movably placed in the housing has at least two flexible tongues or clamps pointing in the direction of the insertion opening, which are guided by a constriction of the housing in the form of an envelope of a cone in such a way that the clamps engage, via protrusions, an annular groove of the connecting part. This engagement position is secured by the action of the spring. When opening this known plug-type clasp it is necessary to grip the housing, to draw back the sleeve against the force of the spring, and to remove the connecting part from the receiving opening of the sleeve. Because at this position the sleeve is in direct connection with the other connecting end of the plug-type clasp, it may happen that an unintended pull at that connecting end of the sleeve will displace the sleeve in the housing against the force of the spring so that its front engaging tongue will release the annular groove of the connecting part. As a result, when a pull is exerted on both sides of the plug-type clasp, it is possible that unintended opening of the clasp, and thus a possible loss of the piece of jewelry, may occur. Manufacture of the sleeve with both the formed connecting end and the flexible tongues is relatively costly.

Because the connecting end disclosed in the above-cited publication is of the eyelet type, it is apparent that this connecting end is intended for connection to corresponding eyelets or components of the connected piece of jewelry, for example a necklace, which are also capable of transferring axial forces such as are required in this case for opening the clasp, i.e., by an axial pull which displaces the sleeve against the housing.

However, there are also other possibilities for attaching and connecting a necklace, for example, to such a clasp. Such attachment may be effected, for example, by techniques such as crimping or riveting. However, connections of this type are not highly resistant to axial stress so that they can be broken relatively easily if pulled. For this reason the known plug-type clasp is not suitable for such uses.

SUMMARY OF THE INVENTION

Thus, it is an object of the invention to improve the known plug-type clasp in such a way as to achieve both structural simplification and manipulation of the clasp without axial stress of the connecting areas.

The above and other objects are achieved, according to the present invention, by a plug-type clasp for securing together the ends of a piece of jewelry, the clasp comprising: a housing having a central longitudinal axis and a front end and a rear end, the ends being spaced apart along the central longitudinal axis of the housing; a sleeve installed in tho housing for movement in the direction of the central longitudinal axis of the housing, the sleeve having a front end which faces the front end of the housing, and the sleeve being provided with a receiving opening which extends from the front end of the sleeve and which has a central longitudinal axis that lies parallel to the central longitudinal axis of the housing; spring means disposed in the housing and acting on the sleeve for urging the sleeve toward the front end of the housing; cover means disposed at the front end of the housing and defining a passage opening having a central longitudinal axis which is laterally offset from the central longitudinal axis of the receiving opening; and connecting means including a connecting part, the connecting part being configured to be capable of passing through the passage opening when the connecting part has a first position and to be capable of passing into the receiving opening when the connecting part has a second position, the first and second positions being offset transverse to the central longitudinal axis of the housing by a distance such that when the connecting part is in the first position it is prevented from entering the receiving opening and when the connecting part is in the second position it is prevented by the cover means from passing through the passage opening, wherein the sleeve is displaceable along the longitudinal axis of the housing, against the urging of the spring means, between a locking position for holding the connecting part in the receiving opening and a release position for permitting the connecting part to move to its second position for passage through the passage opening.

Therefore, the basic idea of the invention lies in providing a lateral offset between the opening at the front end of the housing for inserting the connecting part on the one hand and the receiving opening of the sleeve which is movable in the housing for inserting the connecting part. As a result, passage of the connecting part into the opening in the sleeve is only made possible in the position where the sleeve is pushed back under the force of the spring, because only in this pushed-back position is there sufficient clearance inside the housing for the necessary lateral movement of the front end of the connecting part.

One advantage of this mechanism is that no movable, and in particular no flexible, parts are required on the sleeve.

Furthermore, in a mechanism according to the invention, the sleeve is not connected in one piece with the other connecting end of the plug-type clasp, as it is in the clasp of EP No. 0 121 953, but is movable against the force of the spring by means of an operating button guided in a longitudinally extending slot in the housing.

The application of force for opening the clasp therefore takes place via this operating button, while the application of force for inserting the connecting part takes place directly through the connecting part on the sleeve. Thus, in every case axial pulling stresses of the opposing connecting parts of the plug-type clasp are avoided since the application of forces occurs only between the housing and the sleeve.

Modifications within the spirit of the invention will become apparent from the following description of an exemplary embodiment of the plug-type clasp of the invention, which is illustrated in the accompanying drawings.

DESCRIPTION OF THE PREFERRED EMBODIMENTS

Figure 1:
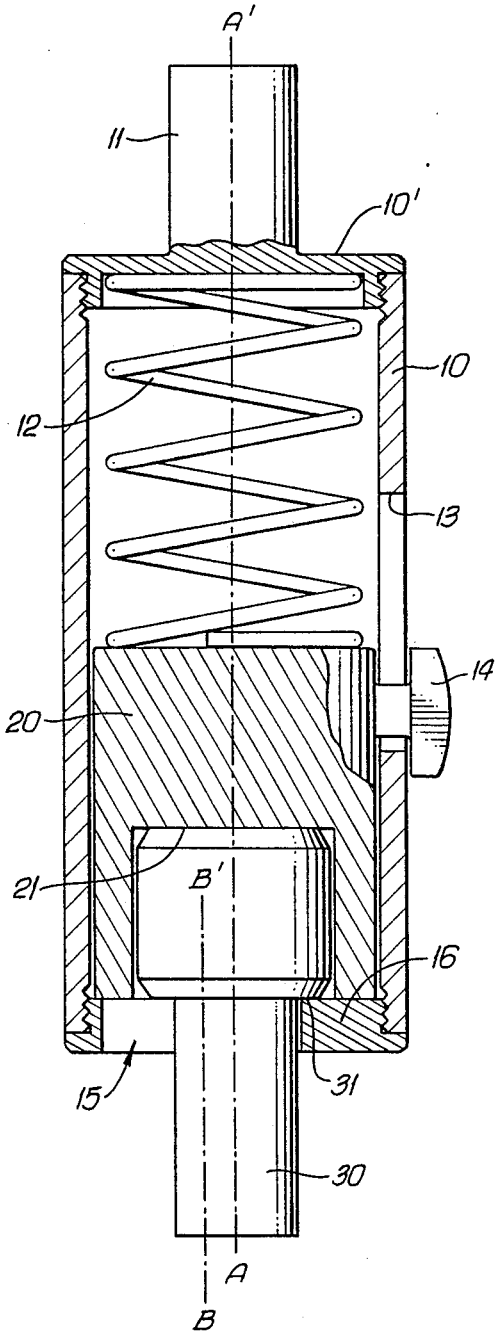
FIG. 1 is a longitudinal cross-sectional view of a plug-type clasp according to a preferred embodiment of the invention.

The plug-type connector according to the invention is composed, in general, of a cylindrical housing 10 and a cylindrical sleeve 20 disposed to be axially displaceable in housing 10. The front end of sleeve 20 is formed to have a cylindrical receiving recess 21 coaxial with the central longitudinal axis A—A' of sleeve 20. Axis A—A' also extends coaxially with the central longitudinal axis of housing 10. Housing 10 has a rear end, shown at the top in FIGS. 1-3, which is closed by a lid 10'. Lid 10' is secured to housing 10 for example by a threaded connection, as shown. Lid 10' carries a connecting peg 11 to receive and retain the end element of a necklace. For example, peg 11 can be a hollow tube which is crimped around the necklace end element. Within housing 10 there is disposed a compression spring 12 which acts between lid 10' and the rear end of sleeve 20 to urge sleeve 20 axially away from lid 10'.

The front end of housing 10 is closed by a cover 16 which secured to housing 10, also by a threaded connection, for example, cover 16 being formed to have a removal and insertion opening 15. The central longitudinal axis B—B' of opening 15 is laterally offset from the axis A—A' of sleeve 20 and receiving opening 21, i.e., axis A—A' and the outline of opening 21 are not aligned with axis B—B' and the outline of opening 15, respectively.

However, the interior cross section, or outline, of receiving opening 21, and also the interior cross section and outline of opening 15 are of such size that a connecting part constituted by the enlarged front end of a connecting element 30 can be inserted into both openings.

The enlarged front end of connecting element 30 is shaped in such a way as to form an annular shoulder 31 which cooperates with the inwardly-directed surface of cover 16 to form a stop. When connecting element 30 is in the inserted and locked position shown in FIG. 1, engagement of shoulder 31 with cover 16 reliably prevents removal of connecting element 30 because lateral yielding of the enlarged front end of connecting element 30 is also prevented by the tight guidance provided by the interior walls of receiving opening 21. Thus, in this locked position, there is no possibility of connecting element 30 leaving the housing 10.

Therefore, for removal it is absolutely necessary to pull sleeve 20 away from cover 16, against the force of spring 12, so that the 'obstructive' side walls of receiving opening 21 are removed. This makes possible a lateral yielding movement of connecting element 30, which is required to allow connecting element 30 to be pulled out through opening 15. It will be noted that withdrawal of the enlarged end of connecting element 30 from housing 10 is aided by a chamfer at the peripheral edge of shoulder 31.

To pull back sleeve 20 inside housing 10, the latter is provided with a longitudinal slot, or hole, 13 through which an operating button 14 projects outwardly. Button 14 may be secured to sleeve 20 after sleeve 20 has been installed in housing 10. For example, button 14 may be screwed or cemented into a bore provided in the side of sleeve 20.

Figure 2:
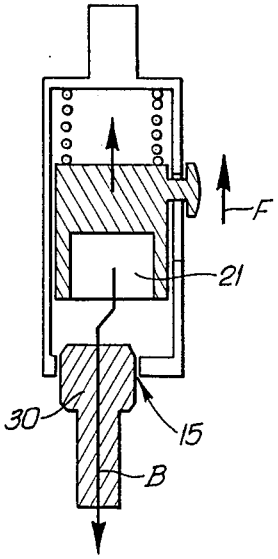
FIG. 2 is a simplified longitudinal cross-sectional view illustrating the removal of the connecting element from the plug-type clasp.
Figure 3:
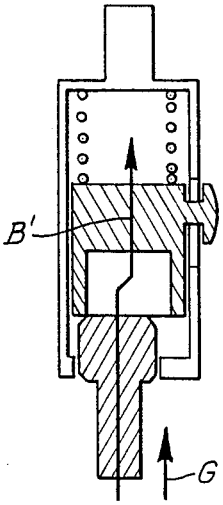
FIG. 3 is a view similar to that of FIG. 2 illustrating the insertion off the connecting element into the plug-type clasp.

The two essential operating actions of the plug-type clasp are sketched out in FIGS. 2 and 3.

Thus, as shown in FIG. 2, movement of sleeve 20 under the action of an external pushing force F on operating button 14 releases the connecting element 30 from opening 21 so that connecting element 30 can be laterally displaced and then pulled out of through opening 15 by a minimal pulling force B.

For closing the clasp, as shown in FIG. 3, it suffices to exert a pushing force G on connecting element 30 sufficient to compress spring 12 to such a degree that sufficient space becomes available in housing 10 between cover 16 and sleeve 20 to the enlarged end of connecting element 30 to move completely past cover 16. Then, connecting element 30 can be laterally displaced so that its longitudinal axis is aligned with the longitudinal axis A—A' of sleeve 20. This immediately causes sleeve 20 to snap forward, toward cover 16, under the force of spring 12 to retain connecting element 30 in its position coaxial with axis A—A' such that it is no longer possible to withdraw connecting element 30 through opening 15.

To ease this lateral yielding movement of connecting element 30 during closing and opening of the plug-type clasp, it is useful that the cooperating annular edges of the enlarged end of connecting element 30 and entrance to opening 21 are chamfered to provide guide surfaces for initiating or easing the lateral yielding movements.

This application relates to subject matter disclosed in Federal Republic of Germany Application No. P 3903342.2, filed on Feb. 4, 1989, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A plug-type clasp for securing together the ends of a piece of jewelry, said clasp comprising: a housing having a central longitudinal axis and a front end and a rear end, said ends being spaced apart along the central longitudinal axis of said housing; a sleeve installed in said housing for movement in the direction of the central longitudinal axis of said housing, said sleeve having a front end which faces said front end of said housing, and said sleeve being provided with a receiving opening which extends from said front end of said sleeve and which has a central longitudinal axis that lies parallel to the central longitudinal axis of said housing; spring means disposed in said housing and acting on said sleeve for urging said sleeve toward said front end of said housing; cover means disposed at said front end of said housing and defining a passage opening having a central longitudinal axis which is laterally offset from the central longitudinal axis of said receiving opening; and connecting means including a connecting part, said connecting part being configured to be capable of passing through said passage opening when said connecting part has a first position and to be capable of passing into said receiving opening when said connecting part has a second position, the first and second positions being offset transverse to the central longitudinal axis of said housing by a distance such that when said connecting part is in the first position it is prevented from entering said receiving opening and when said connecting part is in the second position it is prevented by said cover means from passing through said passage opening, wherein said sleeve is displaceable along the longitudinal axis of said housing, against the urging of said spring means, between a locking position for holding said connecting part in said receiving opening and a release position for permitting said connecting part to move to its second position for passage through said passage opening.

2. A plug-type clasp in accordance with claim 1 wherein said connecting part has an annular shoulder disposed to engage said cover means when said connecting part is located in said receiving opening and said sleeve is in the locking position.

3. A plug-type clasp in accordance with claim 2 wherein said connecting part is provided with chamfered surfaces disposed to cooperate with said sleeve and said cover means for aiding movements of said connecting part between the first and second positions.

4. A plug-type clasp in accordance with claim 1 wherein said connecting part is provided with chamfered surfaces disposed to cooperate with said sleeve and said cover means for aiding movements of said connecting part between the first and second positions.

5. A plug-type clasp in accordance with claim 4 wherein said front end of said sleeve is provided with a chamfered surface bordering said receiving opening for aiding movement of said connecting part to the second position and into said receiving opening.

6. A plug-type clasp in accordance with claim 1 wherein said front end of said sleeve is provided with a chamfered surface bordering said receiving opening for aiding movement of said connecting part to the second position and into said receiving opening.

7. A plug-type clasp in accordance with claim 1 wherein said housing is provided with an opening extending parallel to the central longitudinal axis of said housing and further comprising an operating button secured to said sleeve and projecting through said opening provided in said housing, said button being manually operable for moving said sleeve to its release position against the urging of said spring means.

8. A plug-type clasp in accordance with claim 1 wherein said housing comprises means at said rear end of said housing for attachment to one end of the piece of jewelry and said connecting part constitutes means for attachment to the other end of the piece of jewelry.

* * * * *